United States Patent [19]

Kawamura et al.

[11] 4,213,030

[45] Jul. 15, 1980

[54] SILICON-SEMICONDUCTOR-TYPE THERMAL HEAD

[75] Inventors: Takao Kawamura, Osaka; Kokichi Ishibitsu, Shiga, both of Japan

[73] Assignee: Kyoto Ceramic Kabushiki Kaisha, Kyoto, Japan

[21] Appl. No.: 817,742

[22] Filed: Jul. 21, 1977

[51] Int. Cl.[2] ..... H05B 1/00

[52] U.S. Cl. ..... 219/216; 219/543; 346/76 R

[58] Field of Search ..... 219/216, 543; 346/76 R; 357/28, 56, 80; 427/126, 103; 29/580, 569

[56] References Cited

U.S. PATENT DOCUMENTS

| | | | |
|---|---|---|---|
| 3,496,333 | 2/1970 | Alexander et al. | 219/216 |
| 3,515,850 | 6/1970 | Cady, Jr. | 357/28 X |
| 3,659,334 | 5/1972 | Becke et al. | 29/580 |
| 3,852,563 | 12/1974 | Bohorquez et al. | 219/216 |
| 4,030,408 | 6/1977 | Miwi | 219/216 X |

*Primary Examiner*—C. L. Albritton

*Attorney, Agent, or Firm*—Spensley, Horn, Jubas & Lubitz

[57] ABSTRACT

A silicon-semiconductor type thermal head comprising a substrate of α-alumina ceramic of single crystalline sapphire a silicon layer of high electrical resistance formed on the upper surface of the substrate and exothermic dots of low electrical resistance silicon integrally formed on the high resistance silicon layer.

The silicon semiconductor type thermal head is formed by forming a substrate of α-alumina ceramic of single crystalline and sapphire, forming a high resistance layer of silicon on the α-alumina ceramic, forming a layer of low resistance silicon on the high resistance layer of silicon and selectively etching the low and high resistance silicon layers to produce exothermic dots of low resistance silicon, separated from the substrate by high resistance silicon.

9 Claims, 6 Drawing Figures

SILICON-SEMICONDUCTOR-TYPE THERMAL HEAD

BACKGROUND OF THE INVENTION

1. Field of Invention

The present invention relates to thermal head structures and more particularly to silicon semiconductor type thermal head structures.

2. Prior Art

In a heat sensitive recording system, color printed letters are printed on heat sensitive paper by exothermic dots which generate joul heat from their small resistance when current is applied selectively to them. This systems is now becoming, as is generally known, a main stay among all sorts of recording systems used in thermal instruments because of its dispensable development (owing to its peculiar primary color development), simplicity which is applicable to miniturization, low maintenance, low price etc. There are, however, three species utilized as the thermal head which are the heart of the heat sensitive recording system. The species are the thin film type, the thick film type and the semiconductor type, each having its own merits and demerits respectively. Since the present invention relates to thermal heads of the semiconductor type, advantages and drawbacks of the conventional semiconductor type will be explained.

FIG. 1 is a perspective view and outline of a conventional semiconductor type thermal head. As is seen in FIG. 1, the thermal head is designed in such a manner that a head (a) of a lengthwise rectangular strip obtained from silicon semiconductor is provided on its top surface with thermal dots (b) of similarly obtained silicon-semiconductor. The thermal dots (b) may receive from a heating circuit (not shown in the drawings) signal pulses to heat the heat sensitive paper shifting continuously over the head (a) in the direction indicated by the arrow in the picture and to effectuate momentary and selective exothermic reactions required to construct the desired printed letters. The exothermic reactions cause the corresponding spots of heat sensitive paper to develop color, thereby leading to the formation of images of printed letters thereon.

As for the advantages of the silicon-semiconductor thermal head, they are:

(i) a quick response to heat;
(ii) in principle it can be made up in a fine pattern;
(iii) its active elements are capable of being formed on one in the same head; and
(iv) the exothermic resistance of the dot deteriorates less.

On the other hand, the drawbacks are:

(i) its production steps are intricate and large size heads are difficult to produce;
(ii) its manufacturing costs are expensive;
(iii) its thermal efficency is of a low degree; and
(iv) it is difficult to retain heat therein.

To explain more fully the reasons for the above mentioned drawbacks, the silicon head (a) shown in FIG. 1 is usually formed by means of cutting it out of bulk silicon; but since bulk silicon is limited by nature in its size, it is not possible to obtain a silicon head of as large a size as is desired. Small silicon dots (b) are hard to form at very minute intervals on the head (a) which has been obtained through a troublesome cutting process so that the manufacturing costs invariably are high. The heat capacity of the silicon itself is low from the beginning. Therefore, when heat is generated by the dots (b), it is readily absorbed by the underlying head (a). Consequently, the heat efficency is low resulting in the difficulty of retaining the heat.

SUMMARY OF THE INVENTION

Accordingly, it is the generally object of the present invention to provide a silicon semiconductor type thermal head and method for making same.

It is yet another object of the present invention to provide a silicon semiconductor type thermal head of large size.

It is yet another object of the present invention to provide a method for making a silicon semiconductor type thermal head which is simple and low in cost.

It is another object of the present invention to provide a silicon semiconductor type thermal head with a high degree of thermal efficency.

It is still another object of the present invention to provide a silicon semiconductor type thermal head which retains heats easily.

In keeping with the principles of the present invention, the objects are accomplished by a unique silicon semiconductor type thermal head and method for making same comprising a silicon on sapphire composite body. The semiconductor type thermal head comprises a substrate made of $\alpha$-alumunium ceramic of single crystalline sapphire, a silicon layer of high electrical resistance formed on the upper surface of the substrate and exothermic dots of low electrical resistance silicon integrally formed on the high resistance silicon layer.

The silicon semiconductor type thermal head is formed by forming a substrate of $\alpha$-alumina ceramic of single crystalline and sapphire, forming a high resistance layer of silicon on the substrate, forming a layer of low resistance silicon on the high resistance layer of silicon and selectively etching the low and high resistant silicon layers to produce exothermic dots of low resistance silicon separated from the substrate by said high resistance silicon.

BRIEF DESCRIPTION OF THE DRAWINGS

The abovementioned features and objects of the present invention will become more apparent by reference to the following description in conjunction with the accompanying drawings wherein like reference numerals are like elements, and in which.

DETAILED DESCRIPTION OF THE INVENTION

Figure 1:
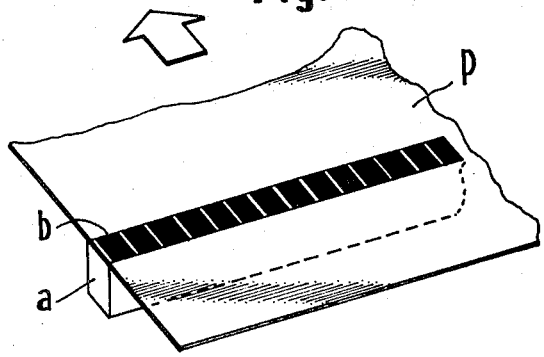
Fig. 1 (Prior Art)
FIG. 1 is a semiconductor type thermal head of the prior art.
Figure 3:
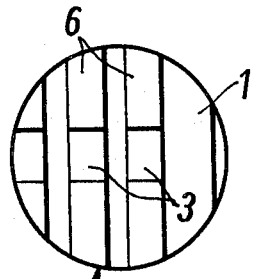
FIG. 3 is a partially enlarged plan view of a portion of the silicon semiconductor type thermal head of FIG. 2.
Figure 2:
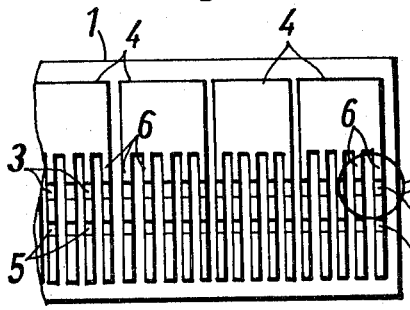
FIG. 2 is a plan view illustrating an example of the patterns of a silicon semiconductor type thermal head in accordance with the teachings of the present invention.
Figure 4:
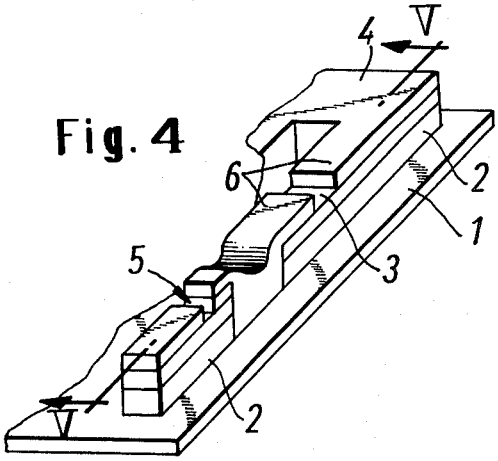
FIG. 4 is an enlarged perspective view of a typical portion of the head of FIG. 2.

Referring more particularly to the drawings, as generally shown in FIGS. 2, 3 and 4, the thermal head consists of a substrate 1 made of α-aluminia ceramic of single crystalline sapphire, a silicon layer 2 of high electrical resistance formed on the substrate 1 and exothermic dots 3 of low electrical resistance silicon intricately formed on the silicon layer 2. As shown, the thermal dots 3 in the present invention are arranged side by side down the center of conductive paths 6 of electrodes 4 and emit joule heat momentarily and selectively towards a heat sensitive paper (not shown) which continually runs over them to make corresponding spots thereon to develop into color to thereby obtain printed letters thereon. In general, as shown in FIG. 2, the thermal head is divided into groups of dots arranged together with conductive paths 6 of electrodes 4 to substantially look like the palm of a hand with fingers extending therefrom.

Figure 5:
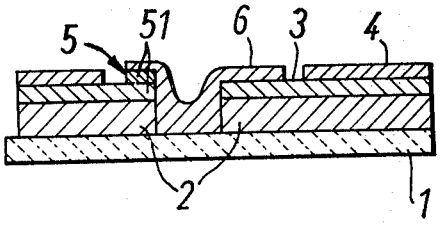
FIG. 5 is an enlarged sectional view taken along the lines IV—IV of FIG. 4.
Figure 6:
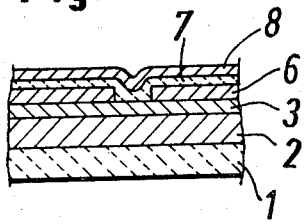
FIG. 6 is a sectional view similar to that of FIG. 5 illustrating another embodiment of a thermal head in accordance with the teachings of the present invention.

Referring also to FIGS. 4, 5 and 6, the silicon semiconductor type thermal head is formed by first forming a substrate 1 of α-aluminia ceramics of single crystalline sapphire. The substrate 1 of α-alumina ceramics of single crystalline sapphire is obtained by the so called EFG process in which a capillary die is set in a molten $\alpha$-$Al_2O_3$ stored in a crucible. Utilizing the capillary dies a single crystal solidified mass of desired sectional configuration, for example ribbon shape, rod shape etc., is pulled up. It should be apparent that there are many other well known methods for making α-alumina ceramics of single crystilline sapphire which could be utilized for this purpose.

Although the thickness of the substrate 1 can be determined at will depending on how is long the distance between capillaries. In the present invention the preferred thickness of the substrate 1 is between 0.5 and 1 millimeters.

Next, a silicon layer 2 of high electrical resistance silicon is grown on the substrate 1 by the epitaxial method. The silicon layer 2 serves as a heat controller and is extremely important to the present invention not only to prevent the loss of heat from the exothermic dots but also to act as a medium for storing heat to the desired degree by choosing its thickness. That is, its thickness should be properly chosen in the range of 1 to 100 microns taking into consideration both the heating value of the exothermic dots 3 and the thickness of the substrate 1. Typically the silicon layer 2 is of a high purity with a doping level of $10^{14}$ to $10^{15}$/cc and has an electrical resistivity of about 10 ohms centimeter. Next, a layer of low resistance silicon is grown over the original silicon layer 2 by the same epitaxial method. It is this low resistance silicon layer which will become the exothermic dots 3.

More specifically, conductive path 6 are formed so as to leave a plurality of exposed areas of the low resistance silicon which is grown over the original silicon layer 2. These exposed areas of the low resistance silicon layer form the thermal dots 3.

The space between the fingers of the thermal head together with a longitudinally extending groove adjacent to that portion of the thermal head which will become the dots 3 and that portion of the thermal head which will become the diodes 5 is etched away by well known etching methods. The diodes 5 are formed by suitably doping a portion of the low resistance silicon to form a PN junction 51. Now the conductive paths 6 of electrode 4 are formed on the surface of the low resistance silicon layer. The connective paths 6 are formed so as to leave thermal dots 3. The conductive paths 6 can be made from any conductive metal such as silver, gold, etc. evaporated on the low resistance silicon. It should be noted however, that when gold is employed for this purpose, it is necessary to first vacuum deposit a chrome layer as a foundation.

The exothermic dots 3 thus formed have a relatively low resistance since the low resistance silicon has a doping level about $10^{18}$/cc and have a resistivity of about 0.01 ohms centimeter and have a thickness of about 0.1 to 3 microns.

The silicon on sapphire (SOS) composite body of the prior art had only one silicon layer, a mono layer imbedded by the epitaxial method over the substrate of α-alumina ceramic of single crystalline sapphire. The present invention includes two silicon layers on the α-aluminia ceramic of single crystalline sapphire so as to adapt one for use as the exthermic dots. As apparent from the above description, the dots 3 obtained from the upper low resistant silicon layer are used only to generate joule heat, while the underlying silicon layer 2 serves to prevent the escape of the generated heat and functions at a medium of moderate storage of heat in cooperation with the substrate 1 and without electrically interfering with the function of the dots 3.

Referring to FIG. 6 is another embodiment of a silicon semiconductor type thermal head in accordance of the teachings of the present invention. In FIG. 6, a wearproof coating 8 of SiC is applied to the top surface of the thermal head. This wearproof coating 8 prevents damage to the thermal head caused by the abrasion of paper continually running over the thermal head.

It should be apparent however, that since SiC is conductive, it is also required to provide an insulating film 7 of $SiO_2$ on the thermal head before applying the coating of SiC.

It should be understood from the above description that the above described silicon semiconductor type thermal head should be constructed such that the silicon layer 2 is of a suitable thickness which is determined by the requirments of heat conduction as well as heat storage and that the exothermic dot 3 is located on top of the silicon layer 2 and a substrate 1 of α-aluminia ceramic having a large heat capacity is situated directly under the silicon layer 2.

From the above construction it should be apparent that the structure has several advantages over the prior art. First of all, the layer 2 prevents the propagation of the heat generated by the dot 3. In other words there is no possibility that the heat generated by the dot 3 will escape away from the heat sensitive paper. This means that it becomes possible to store the heat to some extent by virtue of the existence of the silicon layer 2 which lies between the substrate 1 and the dot 3 thereby bringing about an enhanced heat efficiency for the dots 3 and making the storage of heat easier. Accordingly the present structure displays a high instantaneous thermal reactivity. In addition, the present invention also provides a simple manufacturing process and lowers the production costs since the needed diode here is able to be easily formed directly and the structure of the thermal head can be created by taking advantage of well known techniques of etching, doping, and epitaxial layer generation. In addition, the production costs can also be reduced since the diode 5 can be formed directly in the already grown silicon layer as compared to conventional semiconductor type thermal heads in which an extra diode must be separately provided. In addition, since an α-aluminia ceramic single crystalline sapphire plate can be continuously produced in large size and the silicon layers 2 and dots 3 can be formed out of an epitaxial layer, a large size thermal head may be built as compared with those prior art types which are obviously cut out of bulk silicon.

It should be apparent to one skilled in the art that the above described embodiments are merely illustrative of but a few of the many possibly specific embodiments which can represent the applications of the principles of the present invention. Numerous and various other arrangements can be readily devised by others skilled in the art without departing from the spirit and scope of the invention.

We claim:

1. A silicon semiconductor type thermal head comprising:
   - a substrate of α-alumina ceramic single crystalline sapphire;
   - a silicon layer of high electrical resistance formed on the upper surface of said substrate; and
   - a plurality of exothermic dots defined by a plurality of exposed areas of a silicon layer of low electrical resistance integrally formed on the high resistance silicon layer.

2. A silicon conductor type thermal head according to claim 1 further comprising a plurality of conductive paths formed on said low electrical resistance silicon layer in such a manner that said conductive paths define said exothermic dots and are electrically coupled to said exothermic dots.

3. A silicon semiconductor type thermal head according to claim 2 further comprising a plurality of integrally formed diodes located on said high electrical resistance silicon layer, each of said diodes comprising a P-N junction formed on said low electrical resistance silicon layer, and being electrically coupled at one end to one of said exothermic dots.

4. A silicon semiconductor type thermal head according to claim 1 further comprising a plurality of diodes electrically coupled at one end to one of said exothermic dots.

5. A silicon semiconductor type thermal head according to claim 2 further comprising an insulating film of $SiO_2$ formed on both said exothermal dots and said conductive paths, and a film of SiC formed over said film of $SiO_2$.

6. A silicon conductor type thermal head according to claim 1 wherein said thermal head comprises a plurality of side-by-side electrodes with each said electrode having a plurality of conductive fingers, each of said conductive fingers exposing at least one of said exothermic dots.

7. A silicon semiconductor type thermal head comprising:
   - a substrate of α-aluminia ceramic single crystalline sapphire;
   - a silicon layer of high electrical resistance formed on the upper surface of said substrate; and
   - a silicon layer of low electrical resistance formed on the upper surface of the high resistance silicon layer; and
   - a coating formed over said silicon layer of low electrical resistance such that a plurality of exposed areas of said low electrical resistance silicon layer extends through said coating.

8. A silicon semiconductor type thermal head according to claim 7 wherein said coating forms a conductive pathway on said low electrical resistance silicon layer.

9. A silicon semiconductor type thermal head according to claim 7 wherein said thermal head is comprises a plurality of side-by-side electrodes with each said electrode having a plurality of conductive fingers, each of said conductive fingers exposing at least one of said exothermic dots.

* * * * *